US007727082B2

(12) United States Patent
Larsen

(10) Patent No.: US 7,727,082 B2
(45) Date of Patent: Jun. 1, 2010

(54) GOLF SWING GUIDE

(76) Inventor: M. Don Larsen, 73 S. Main St., Smithfield, UT (US) 84335

( * ) Notice: Subject to any disclaimer, the term of this patent is extended or adjusted under 35 U.S.C. 154(b) by 0 days.

(21) Appl. No.: 12/208,199

(22) Filed: Sep. 10, 2008

(65) Prior Publication Data

US 2009/0075746 A1 Mar. 19, 2009

Related U.S. Application Data

(60) Provisional application No. 60/971,108, filed on Sep. 10, 2007.

(51) Int. Cl.
*A63B 69/36* (2006.01)

(52) U.S. Cl. ..... 473/257; 473/221; 473/258

(58) Field of Classification Search ..... 473/257, 473/258, 259, 260, 261, 263, 264, 265, 266, 473/422, 219, 221
See application file for complete search history.

(56) References Cited

U.S. PATENT DOCUMENTS

| | | | | |
|---|---|---|---|---|
| 1,890,696 | A * | 12/1932 | Rosenhahn | 482/90 |
| 3,022,072 | A * | 2/1962 | Zinnow | 482/90 |
| 5,013,044 | A | 5/1991 | Hesselbart | |
| 5,485,993 | A * | 1/1996 | Lipsett | 473/448 |
| 5,595,545 | A | 1/1997 | O'Brien | |
| 5,769,732 | A | 6/1998 | O'Neal | |
| 6,312,345 | B1 | 11/2001 | Pelz | |
| 6,364,786 | B1 | 4/2002 | Khano | |
| 6,551,197 | B1 * | 4/2003 | Travo | 473/258 |
| 7,335,136 | B2 * | 2/2008 | Brodbeck | 482/55 |
| 2005/0215342 | A1 | 9/2005 | Edwards et al. | |

* cited by examiner

*Primary Examiner*—Nini Legesse
(74) *Attorney, Agent, or Firm*—Matthew D. Thayne; Stoel Rives LLP

(57) ABSTRACT

Disclosed are embodiments of golf swing guide apparatus and related methods and systems. Various embodiments disclosed herein may be used as a training tool to teach a desired swing motion to a golfer. In one embodiment, the device may comprise a guide bar positioned at some height above the ground. The guide bar may be configured to guide a golfer's backswing such that the swing begins in a desired swing plane. In some embodiments, the device may be configured to automatically retract the guide bar during, or after, the golfer's backswing such that it does not interfere with the forward movement of the golf swing.

18 Claims, 6 Drawing Sheets

GOLF SWING GUIDE

RELATED APPLICATIONS

This application claims the benefit under 35 U.S.C. §119 (e) of U.S. Provisional Patent Application No. 60/971,108, filed Sep. 10, 2007, and titled "Golf Swing Guide," which is incorporated herein by specific reference.

BRIEF DESCRIPTION OF THE DRAWINGS

Understanding that drawings depict only certain preferred embodiments and are not therefore to be considered to be limiting in nature, the preferred embodiments will be described and explained with additional specificity and detail through the use of the accompanying drawings in which.

DETAILED DESCRIPTION OF PREFERRED EMBODIMENTS

Figure 1:
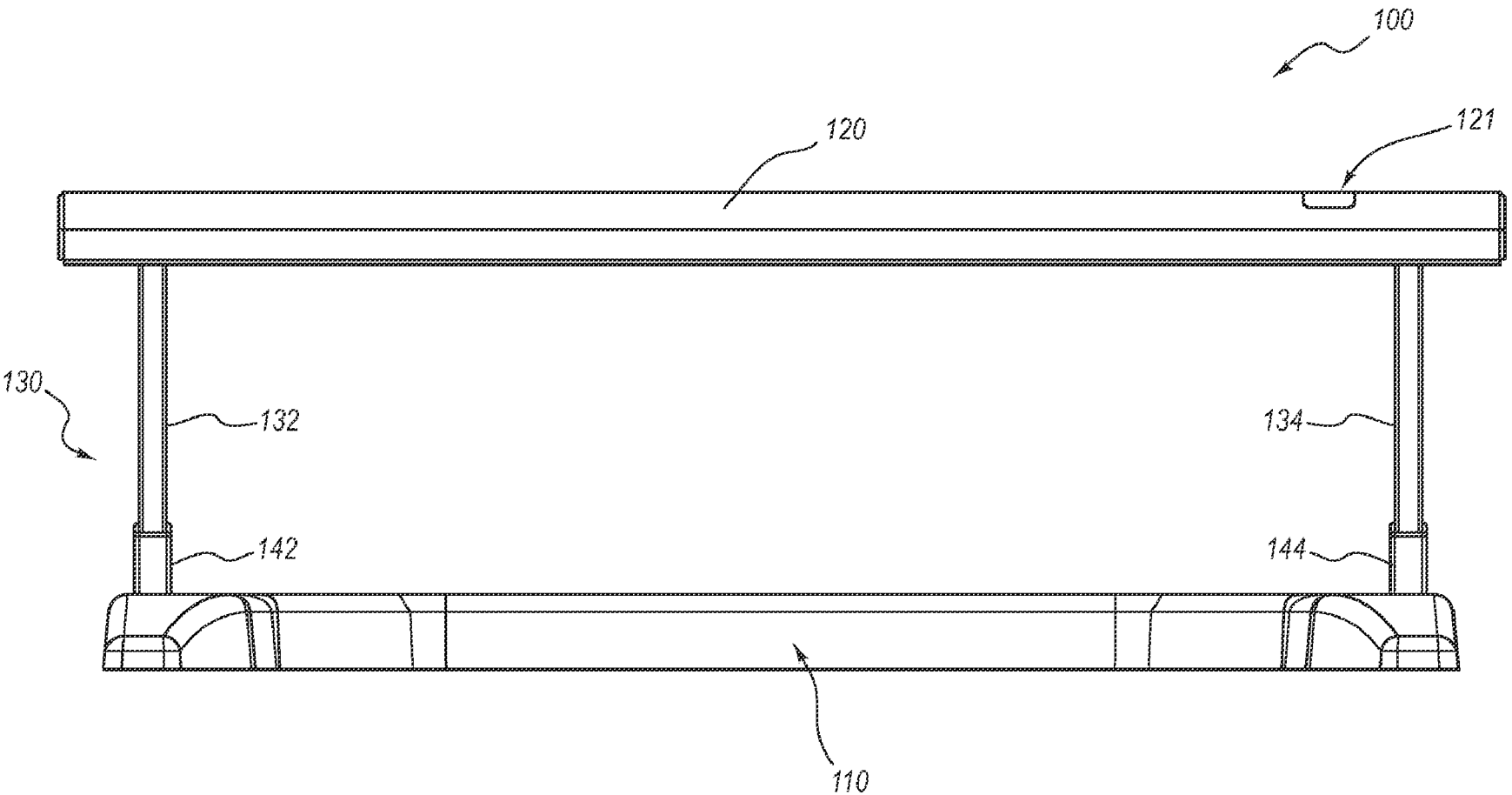
FIG. 1 is a rear elevation view of one embodiment of a golf swing guide.

In the following description, numerous specific details are provided for a thorough understanding of specific preferred embodiments. However, those skilled in the art will recognize that the invention can be practiced without one or more of the specific details, or with other methods, components, materials, etc.

In some cases, well-known structures, materials, or operations are not shown or described in detail in order to avoid obscuring aspects of the preferred embodiments. Furthermore, the described features, structures, or characteristics may be combined in any suitable manner in one or more embodiments.

Disclosed are embodiments of a golf swing guide apparatus and related methods and systems. Various embodiments of the invention may be used as a training tool to teach a desired swing motion to a golfer. In one embodiment, the device may comprise a guide bar positioned at some height above the ground. The guide bar may be configured to guide a golfer's backswing such that the swing begins in a desired swing plane. In some embodiments, the guide bar may be positioned between approximately ten inches and approximately eighteen inches from the ground. In some embodiments, the position of the guide bar relative to the ground may also be adjustable to allow for use by golfers of different sizes and/or for use in connection with different club types.

In some embodiments, the guide bar is held in place by a support structure, which may comprise a plurality of supports. For example, in one embodiment, supports are provided at approximately both ends of the guide bar. The guide bar may be configured to retract out of the path of the golfer's swing following the backswing such that it does not interfere with the forward motion of the swing.

In some embodiments, the device may be configured such that the motion of the backswing actuates retraction of the guide bar. For example, in some embodiments, one or more sensors may be used to detect when the backswing has reached a particular point and actuate a retraction mechanism as a result. The retraction mechanism may be coupled with the support structure. In other embodiments, the force of the golfer's backswing may be employed to retract the guide bar. For example, the golfer's backswing may engage a switch or other actuation trigger at some point during the backswing which, in turn, may actuate a retraction mechanism. In other embodiments, the golfer's backswing may engage a mechanism that manually retracts the guide bar by using only the force of the golfer's backswing.

In some embodiments, the position of the guide bar relative to the ground may be adjustable to allow for use by golfers of different sizes and/or for use in connection with different club types. For example, the guide bar support structure may include telescoping guide bar support members that are lockable in a plurality of different positions corresponding with a plurality of different guide bar heights.

Various embodiments of the device may be used in golf training exercises. For example, in one such exercise, a golfer holds a golf club with the guide bar in between the club and the golfer. The golfer may then begin a swing with the club sliding along the guide bar to guide the plane of the backswing, thereby helping to train the golfer's muscles and skeletal positioning to swing in the pattern constrained by the guide bar. As the golf swing proceeds beyond the rear end of the guide bar, a retraction mechanism may be employed to move the guide bar out of the way of the forward swing, such that the golfer does not strike the device.

In some embodiments, as the golf club slides along the guide bar, it may trigger the guide bar retraction by detecting the presence of the golf club with an electronic sensor or sensors embedded within the device. For example, one or more sensors may be attached to the guide bar itself. The electronic sensor(s) may employ any of a variety of mechanical switches or sensing mechanisms, such as an ultrasonic sensor, a radio frequency signal, or an electric switch. In some embodiments, ultrasonic waveforms may be used in the sensor(s).

Other embodiments are contemplated in which a mechanical actuation trigger, such as a wire or lever, could protrude from the guide bar. The mechanical actuation trigger could serve as a manual mechanical switch to trigger retraction of the guide bar out of the way as the club passes by on the backswing. Alternatively, the force of the backswing could cause the mechanical actuation trigger itself to physically move the guide bar out of the way without merely acting as an intermediary switch.

Still other embodiments are contemplated in which the retraction mechanism can be selectively deactivated. This may be useful because for certain types of golf swings, it may be desirable to have the guide bar in a forward or operative position during not only the backswing, but the forward portion of the swing as well. For example, putting requires a relatively slow and precise swing motion that could benefit from having a guide bar in place for both the back and forward portions of the swing. As such, some embodiments may comprise a switch, button, or other component configured to selectively deactivate the retraction mechanism. This may be accomplished by covering, disconnecting, or otherwise disabling a sensor, or by disconnecting or otherwise disabling the retraction mechanism itself, for example. These embodiments may therefore be used for full golf swings and then, after the deactivation component has been actuated, may also be used for putting golf swings.

The guide bar may be retracted via an electrically-driven latch mechanism. In such embodiments, the latch mechanism may include a rotary encoder, a solenoid/spring latch, and/or an electric motor.

In one particular embodiment, a guide bar is provided that is configured to guide the swing of a golf club such that the swing begins in a desired swing plane. A guide bar support structure coupled with the guide bar may also be provided. The guide bar support structure may be configured to support the guide bar in at least a first configuration and a second configuration. In the first configuration, the guide bar is positioned so as to allow the golf club to move adjacent to the guide bar during a backswing of the golf club. In the second configuration, the guide bar is positioned away from a path of the golf club taken during the backswing of the golf club so as to allow the golf club to swing forward without being obstructed by the guide bar.

A retraction mechanism configured to retract the guide bar from the first configuration to the second configuration may also be provided, as described in greater detail elsewhere herein. The retraction mechanism may comprise a spring mechanism configured to bias the guide bar towards the second configuration. In other words, the spring mechanism biases the guide bar towards a retracted position in which the guide bar is removed from the path of the golf club. A locking mechanism may also be provided that is configured to lock the guide bar in the first configuration. The locking mechanism may include a retention pin releasably engaged with the guide bar support structure. The retention pin may be configured, for example, to be received within an opening in a guide bar support member. A release mechanism may also be provided. Such a release mechanism may be configured to release the guide bar from being locked in the first configuration. The release mechanism may be configured to release the retention pin from the guide bar support structure, such as by withdrawing the retention pin from the opening, to allow the guide bar to retract to the second configuration.

More specific embodiments of the invention will now be described in greater detail as examples with reference to the accompanying drawings. FIG. 1 depicts an embodiment of a golf swing guide 100 comprising a base 110, a guide bar assembly 120, and a guide bar support 130. Guide bar assembly 121 includes a sensor 121 that is configured to detect when a golf club passes by the sensor 121. Guide bar support 130 includes first and second guide bar support members 132 and 134, respectively. Guide bar support member 132 fits within and is supported by guide bar support member socket 142 and guide bar support member 134 fits within and is supported by guide bar support member socket 144. Guide bar support member sockets 142 and 144 are also configured to pivot with respect to base 110 to allow guide bar assembly 120 to retract away from the plane of a golfer's swing. More particularly, guide bar support member sockets 142 and 144 pivot between a forward position and a retracted position such that the guide bar can move between a forward position for guiding a golfer's backswing and a retracted position that prevents it from interfering with the forward motion of the golf swing.

Figure 2:
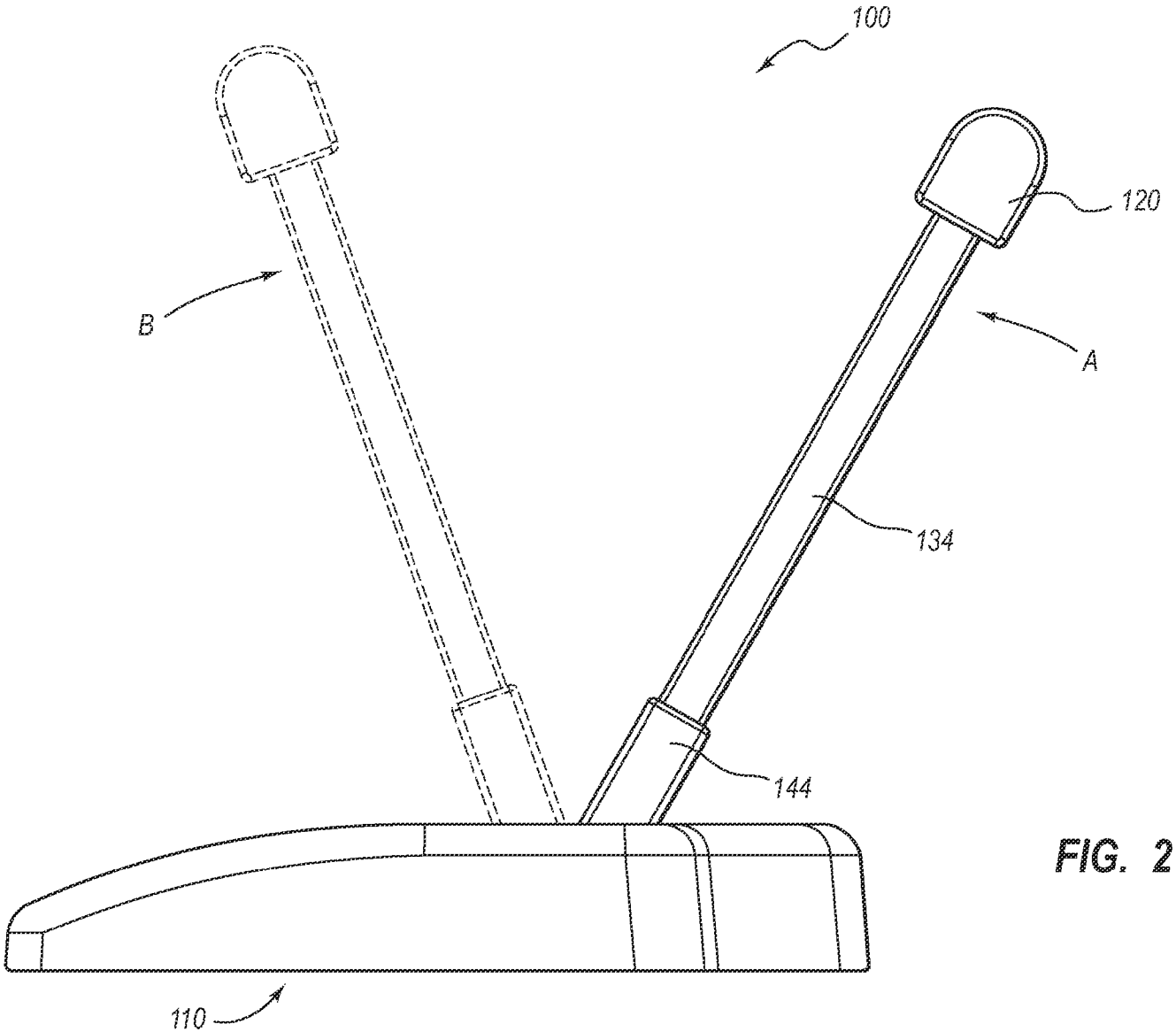
FIG. 2 is a side elevation view of the golf swing guide of FIG. 1.

FIG. 2 depicts a side elevation view of golf swing guide 100. In this figure, it can be seen that guide bar support member socket 144 (and guide bar support member socket 142, not shown in FIG. 2) pivots between a forward or operative position and a retracted position. The pivoting of the guide bar support member sockets causes the guide bar support members and the guide bar to move between a forward position and a retracted position. The forward position is shown in FIG. 2 at "A" and the retracted position in phantom at "B."

Figure 3:
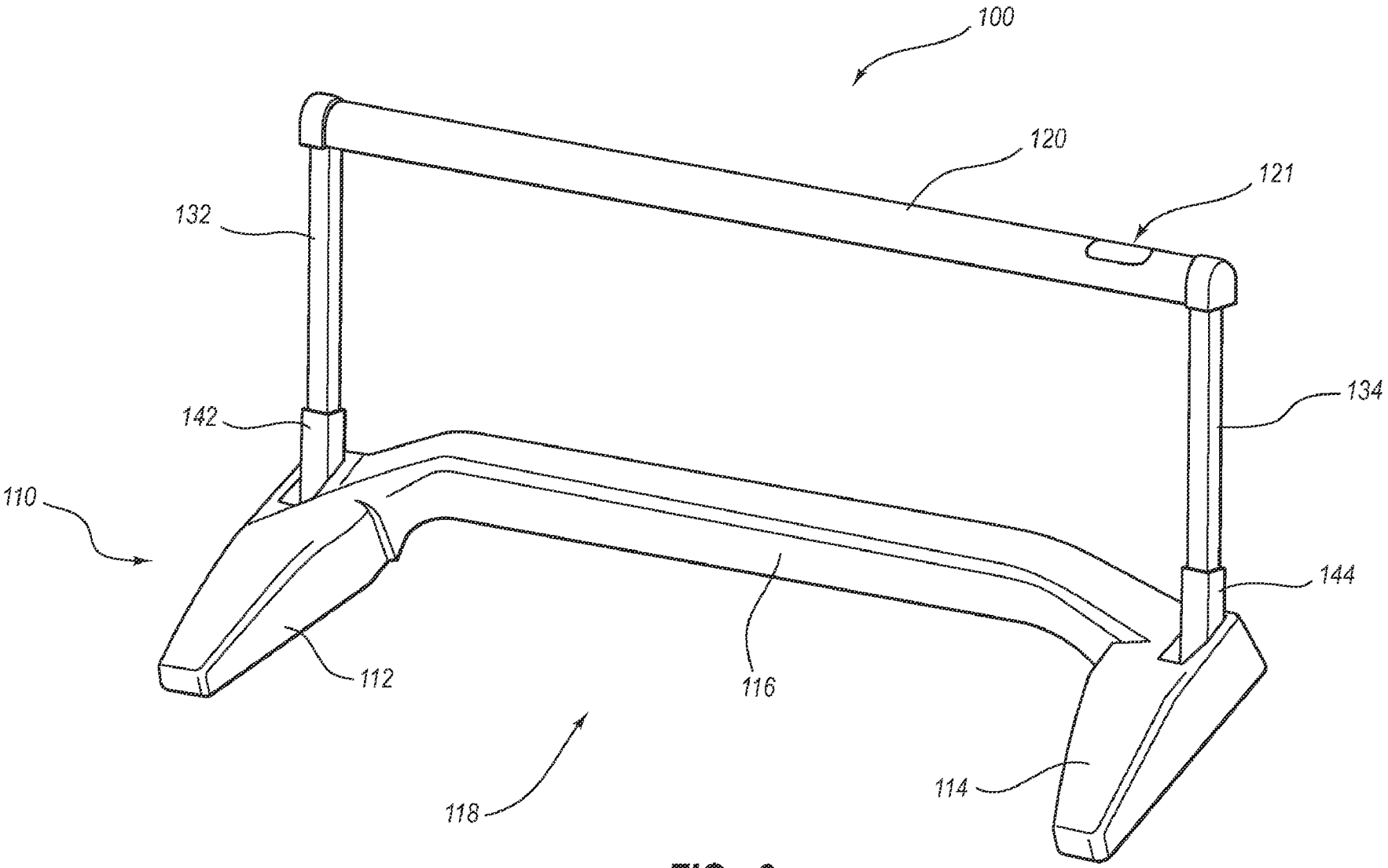
FIG. 3 is a perspective view of the golf swing guide of FIGS. 1 and 2.

FIG. 3 is a perspective view of golf swing guide 100. From this figure, it can be seen that base 110 comprises support platforms 112 and 114, which are connected by cross member 116. An open or standing region 118 is positioned behind cross member 116. A user will stand in region 118 while using the device.

Figure 4:
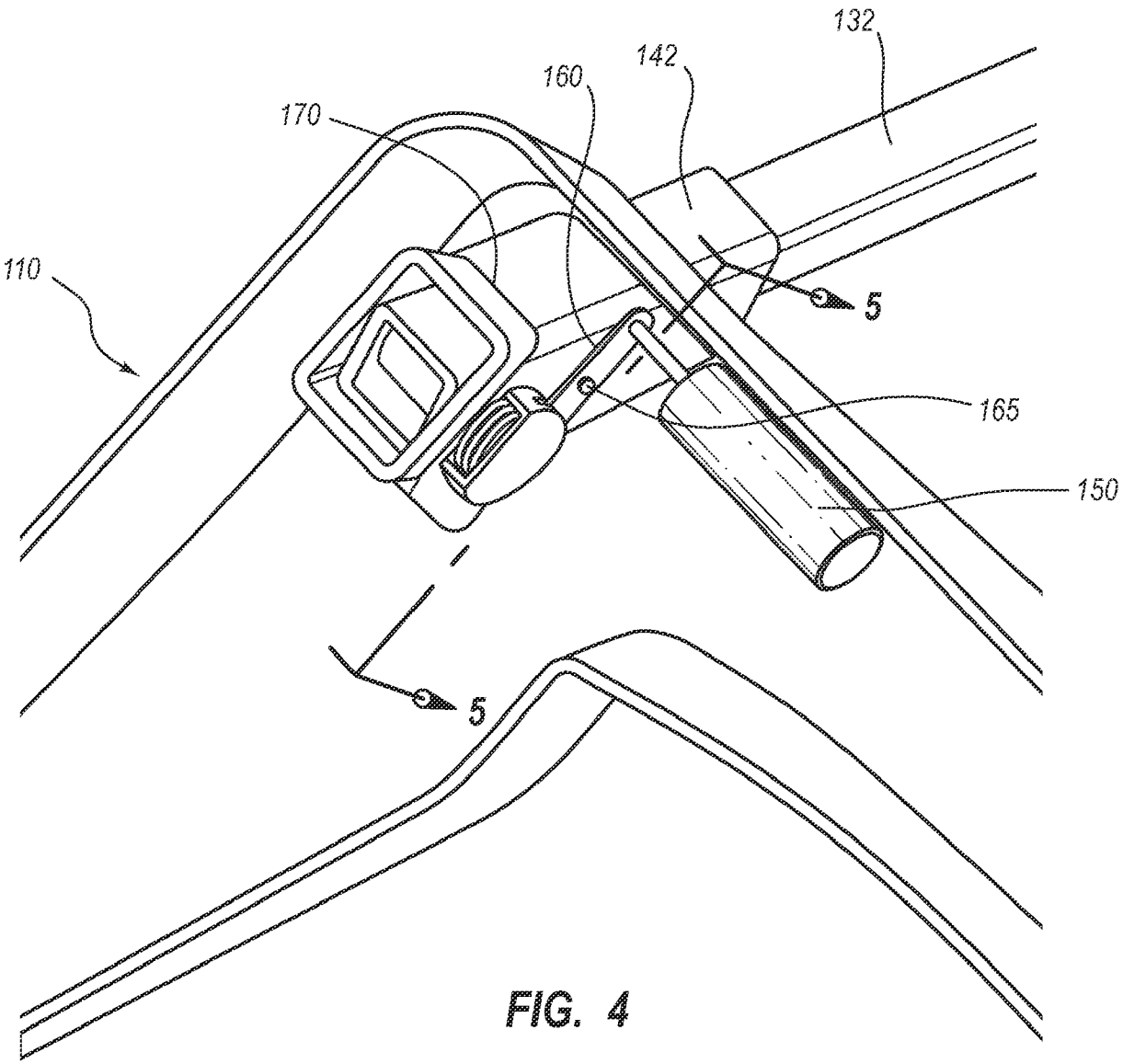
FIG. 4 is a perspective view of the underside of one corner of the golf swing guide of FIGS. 1-3 showing the physical relationship of several components that make up the retraction mechanism of the device.

FIG. 4 depicts the underside of one corner of golf swing guide 100 showing the physical relationship of several components that make up the retraction mechanism. As seen in the figure, a solenoid 150 is provided, which is operatively connected to a spring latch 160. A retention pin 165 is also provided, which engages with the guide bar support member socket 142. A torsion spring 170 is also provided. Torsion spring 170 may be configured so as to bias the guide bar assembly 120 in the retracted position at which the guide bar is positioned closer to the golfer relative to the forward position.

Retention pin 165 may be configured to fit within an opening in the guide bar support member socket 142 to lock the guide bar assembly 120 in the forward position. In this position, torsion spring 170 is in a loaded state. Thus, upon release of the retention pin 165 from guide bar support member socket 142, the guide bar assembly automatically retracts from its forward position and moves towards the golfer to its retracted position. Solenoid 150 is positioned and configured to move spring latch 160, which, in turn, disengages retention pin 165 from guide bar support member socket 142 and allows the guide bar to retract.

Figure 5:
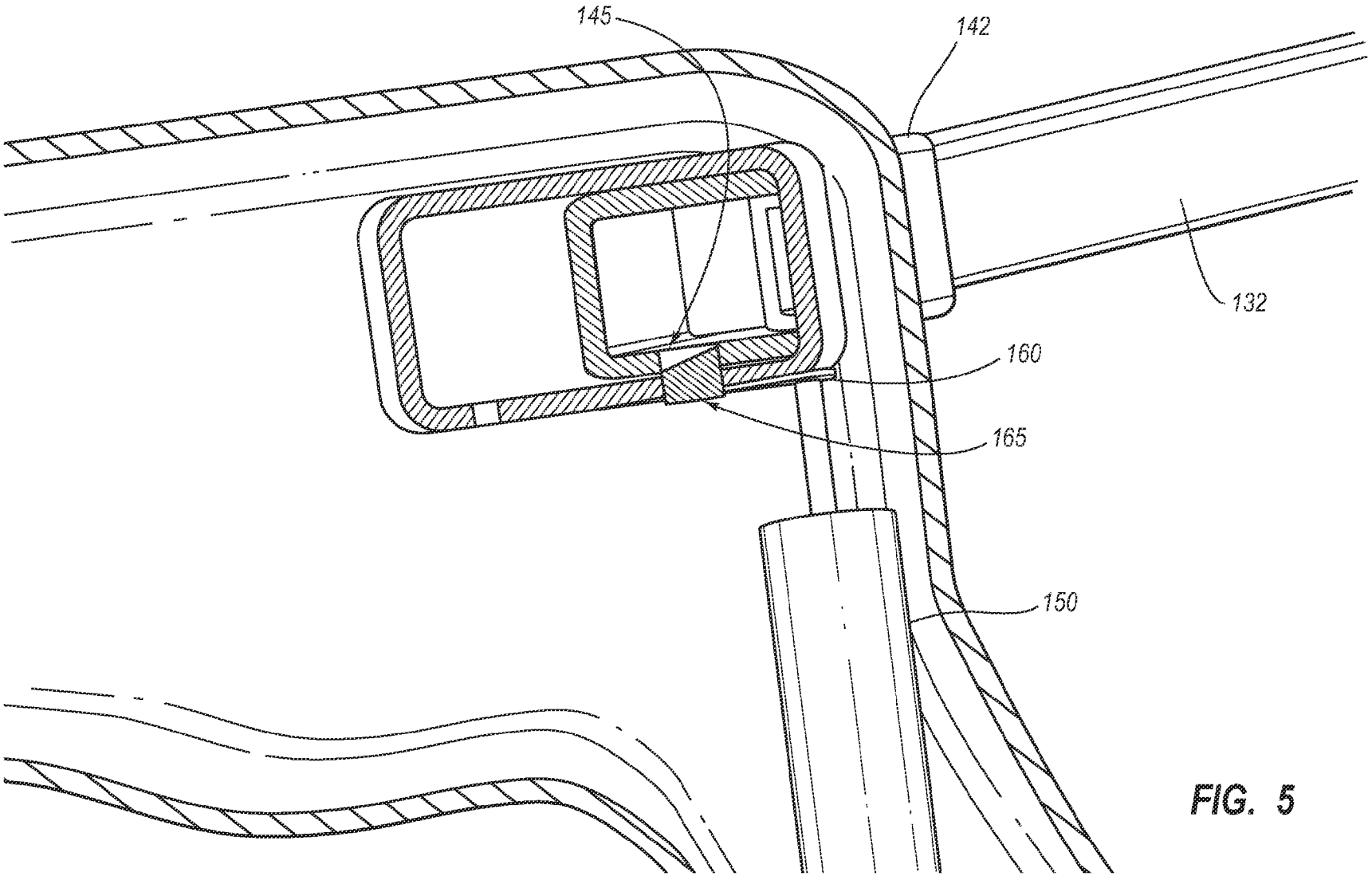
FIG. 5 is a cross-sectional view of the underside of one corner of the golf swing guide of FIGS. 1-4, taken along line 5-5 of FIG. 4, which cuts through the retention pin of the device.

FIG. 5 depicts a cross-sectional view of the underside of one corner of golf swing guide 100. The cross-section is taken through retention pin 165, thereby making the interaction between retention pin 165 and opening 145 in guide bar support member socket 142 more apparent. Spring latch 160 is operatively coupled with solenoid 150. As such, actuation of solenoid 150 causes spring latch 160 to be pivoted or pulled away from guide bar support member socket 142. This results in retention pin 165 being withdrawn from opening 145. In some embodiments, retention pin 165 and/or opening 145 may be angled or otherwise configured to facilitate removal of retention pin 165 from opening 145 upon actuation of solenoid 150. For example, in embodiments in which spring latch 160 pivots, the top of retention pin 165 may be angled or ramped to allow the retention pin to retract out of opening 145 as spring latch 160 is pivoted.

Once retention pin 165 has been withdrawn from opening 145, torsion spring 170 (not shown in FIG. 5) forces the guide bar from its forward position to its retracted position. Of course, the opposite end of the device (corresponding with guide bar support member 134 and guide bar support member socket 144) may, in some embodiments, also be configured with similar components, such as another solenoid, torsion spring, spring latch, and retention pin.

In embodiments including a sensor positioned on or near the guide bar, a signal from the sensor circuitry may provide electrical power to the solenoid, which causes the solenoid to actuate and pull the spring latch back to disengage the retention pin. In some embodiments, a battery pack may be included to provide power for the solenoid drive circuitry. A circuit and/or batteries may also be provided for the sensor.

Figure 6:
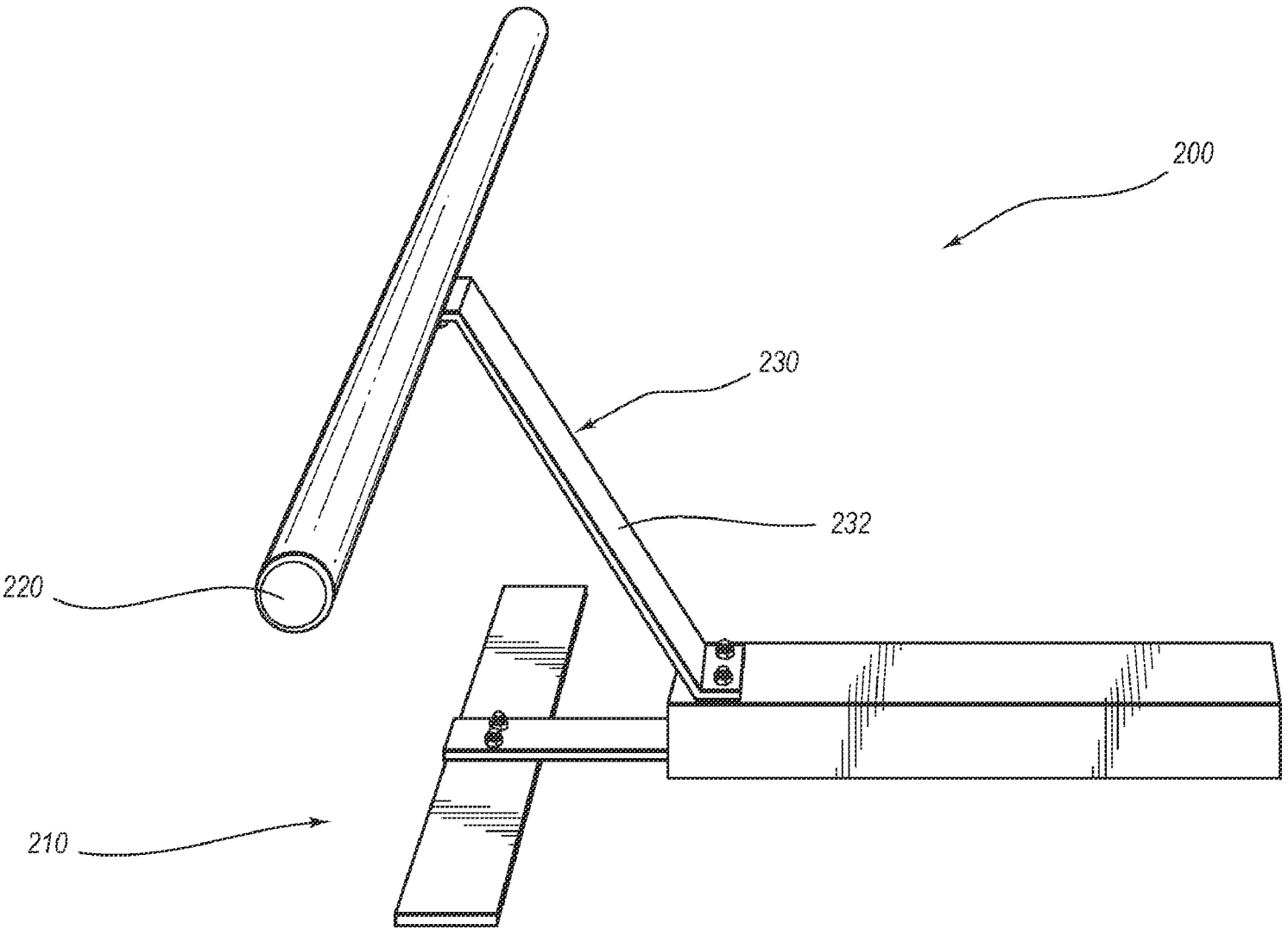
FIG. 6 is a perspective view of another embodiment of a golf swing guide.

Another embodiment of a golf swing guide 200 is shown in FIG. 6. Golf swing guide 200 comprises a base 210, a guide bar assembly 220, and a guide bar support 230. Unlike guide bar support 130 of golf swing guide 100, guide bar support 230 includes only a single guide bar support member 232. Other features of golf swing guide 200 may be similar to those previously described with reference to golf swing guide 100. For example, guide bar support member 232 may be configured to pivot with respect to base 210 to allow guide bar assembly 220 to retract away from the plane of a golfer's swing. Guide bar support member 232 may pivot between a forward position and a retracted position such that the guide bar assembly 220 can move between a forward position for guiding a golfer's backswing and a retracted position that prevents it from interfering with the forward motion of the golf swing. Mechanisms and sensors for retracting guide bar assembly 220 may be similar to those shown and described with reference to golf swing guide 100.

Guide bar assembly 120 and guide bar assembly 220 are examples of means for guiding the plane of a golf backswing. Solenoid 150, along with torsion spring 170, is an example of a means for retracting a means for guiding the plane of a golf backswing. Any of the sensors discussed herein are examples of means for sensing a golf backswing and, upon sensing the golf backswing, actuating a means for retracting a means for guiding the plane of a golf backswing.

The above description fully discloses the invention including preferred embodiments thereof. Without further elaboration, it is believed that one skilled in the art can use the preceding description to utilize the invention to its fullest extent. Therefore the examples and embodiments disclosed herein are to be construed as merely illustrative and not a limitation of the scope of the present invention in any way.

It will be obvious to those having skill in the art that many changes may be made to the details of the above-described embodiments without departing from the underlying principles of the invention. The scope of the present invention should, therefore, be determined only by the following claims.

The invention claimed is:

1. A device for training a golf swing, comprising:

a guide bar configured to guide the swing of a golf club such that the swing begins in a desired swing plane;

a guide bar support structure coupled with the guide bar and configured to support the guide bar in a position so as to allow the golf club to move adjacent to the guide bar during a backswing of the golf club, wherein the guide bar is configured to automatically retract away from a path of the golf club taken during the backswing of the golf club;

a retraction mechanism coupled to the guide bar and configured to retract the guide bar; and at least one sensor coupled to the retraction mechanism, wherein the at least one sensor is positioned and configured to detect when the backswing has reached an actuation position along the guide bar and actuate the retraction mechanism when the backswing has reached the actuation position.

2. The device of claim 1, wherein the device is configured such that the motion of the backswing causes the retraction of the guide bar.

3. The device of claim 2, wherein the device is configured such that the force of the backswing retracts the guide bar.

4. The device of claim 3, further comprising an actuation trigger and a retraction mechanism coupled to the actuation trigger and configured to retract the guide bar, wherein the device is configured such that the force of the backswing engages the actuation trigger, and wherein the engagement of the actuation trigger actuates the retraction mechanism to retract the guide bar.

5. The device of claim 1, wherein the guide bar support structure is configured to allow a user to adjust the height of the guide bar.

6. The device of claim 1, wherein the guide bar support structure comprises at least one guide bar support member coupled with the guide bar.

7. The device of claim 6, further comprising a base coupled with the at least one guide bar support member.

8. The device of claim 7, wherein the at least one guide bar support member is configured to pivot with respect to the base to allow the guide bar to retract.

9. The device of claim 8, further comprising a spring mechanism configured to bias the at least one guide bar support member towards a first configuration, wherein the guide bar is in a retracted configuration when the at least one guide bar support member is in the first configuration.

10. The device of claim 9, further comprising a retention pin configured to retain the at least one guide bar support member in a second configuration, wherein the guide bar is in a guiding configuration when the at least one guide bar support member is in the second configuration, and wherein the guiding configuration allows a golfer to guide the swing of a golf club such that the swing begins in a desired swing plane.

11. A device for training a golf swing, comprising:

a guide bar configured to guide the swing of a golf club such that the swing begins in a desired swing plane;

a guide bar support structure coupled with the guide bar and configured to support the guide bar in at least a first configuration and a second configuration, wherein, in the first configuration, the guide bar is positioned so as to allow the golf club to move adjacent to the guide bar during a backswing of the golf club, and wherein, in the second configuration, the guide bar is positioned away from a path of the golf club taken during the backswing of the golf club;

a retraction mechanism configured to retract the guide bar from the first configuration to the second; and at least one sensor coupled to the retraction mechanism, wherein the at least one sensor is positioned and configured to detect when the backswing has reached an actuation position along the guide bar and actuate the retraction mechanism when the backswing has reached the actuation position.

12. The device of claim 11, wherein the retraction mechanism comprises a spring mechanism configured to bias the guide bar towards the second configuration.

13. The device of claim 12, further comprising a locking mechanism configured to lock the guide bar in the first configuration.

14. The device of claim 13, wherein the retraction mechanism further comprises a release mechanism configured to release the guide bar from being locked in the first configuration.

15. The device of claim 14, wherein the locking mechanism comprises a retention pin releasably engaged with the guide bar support structure, wherein the release mechanism is configured to release the retention pin from the guide bar support structure to allow the guide bar to retract to the second configuration.

16. The device of claim 11, wherein the device is configured such that the motion of the backswing actuates the retraction mechanism.

17. The device of claim 11, further comprising a deactivation component configured to selectively deactivate the retraction mechanism.

18. A device for training a golf swing, comprising:

a guide bar configured to guide the swing of a golf club such that the swing begins in a desired swing plane;

a guide bar support structure coupled with the guide bar and configured to support the guide bar in an operative position so as to allow the golf club to move adjacent to the guide bar during a backswing of the golf club;

a retraction mechanism coupled to the guide bar and configured to retract the guide bar from the operative position to a retracted position, wherein the retraction mechanism comprises a spring mechanism configured to bias the guide bar towards the retracted position;

a locking mechanism configured to lock the guide bar in the operative position;

a release mechanism configured to release the guide bar from being locked in the operative position and allow the spring mechanism to move the guide bar to the retracted position; and at least one sensor coupled to the retraction mechanism, wherein the at least one sensor is positioned and configured to detect when the backswing has reached an actuation position along the guide bar and actuate the retraction mechanism when the backswing has reached the actuation position.

* * * * *